United States Patent [19]

Severson

[11] 4,066,295

[45] Jan. 3, 1978

[54] CHAIR AND BASE FRAME THEREFOR

[76] Inventor: Harvey M. Severson, 8418 Dupont Ave. South, Minneapolis, Minn. 55420

[21] Appl. No.: 745,952

[22] Filed: Nov. 29, 1976

[51] Int. Cl.[2] ..... A47C 7/00

[52] U.S. Cl. ..... 297/443; 248/188

[58] Field of Search ..... 297/443, 445; 248/188

[56] References Cited

U.S. PATENT DOCUMENTS 3,971,587 7/1976 Curtis et al. ..... 297/445

FOREIGN PATENT DOCUMENTS 955,670 1/1950 France ..... 297/445

*Primary Examiner*—James C. Mitchell

*Attorney, Agent, or Firm*—Merchant, Gould, Smith, Edell, Welter & Schmidt

[57] ABSTRACT

A generally rectangular rigid one-piece base frame having a generally flat top for supporting a chair seat and formed to provide bosses which define downwardly opening recesses for reception of the upper ends of chair legs. A pair of other bosses define upwardly opening recesses disposed to receive the lower end portions of backrest structure, the base frame holding the entire chair structure together.

2 Claims, 4 Drawing Figures

CHAIR AND BASE FRAME THEREFOR

SUMMARY OF THE INVENTION

An important object of this invention is the provision of a base frame structure to which may be rigidly attached a seat element, supporting legs, and backrest structure, to provide a highly simplified and efficient article of furniture, and which will accommodate a seat, legs, and head rest structure of various designs and patterns. To the above ends is provided a generally rectangular base frame member having spaced portions defining a plurality of leg receiving recesses. Said frame member defines recess means generally intermediate a given pair of said leg receiving recesses for reception of a backrest support, the frame member having a generally flat top surface for supporting a seat element.

DETAILED DESCRIPTION OF THE PREFERRED EMBODIMENT

Figure 1:
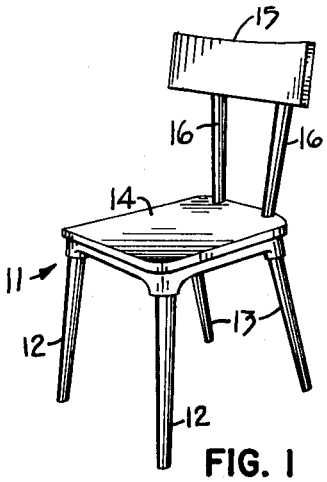
FIG. 1 is a view in perspective of a chair embodying the base frame of this invention, as seen from the front and one side of the chair.
Figure 2:
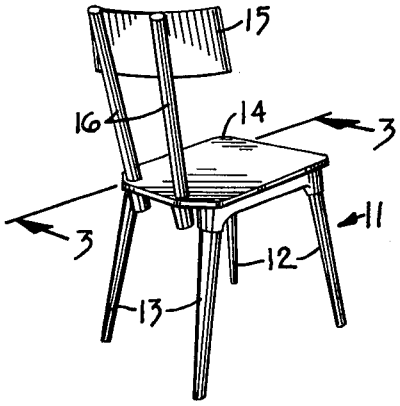
FIG. 2 is a view in perspective of the chair of FIG. 1 as seen from the other side and rear.
Figure 3:
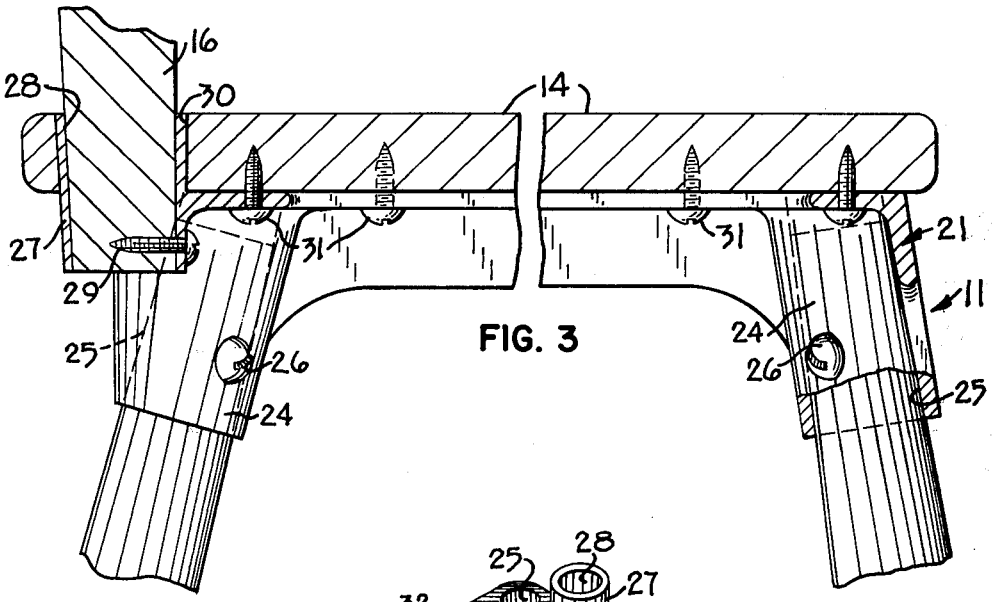
FIG. 3 is an enlarged fragmentary section taken generally on the line 3—3 of FIG. 2.

In FIGS. 1–3, a chair is shown as comprising a base frame 11, pairs of front and rear legs 12 and 13 respectively, a seat element 14 overlying the base frame 11, a backrest member 15, and backrest supporting bars or rods 16.

Figure 4:
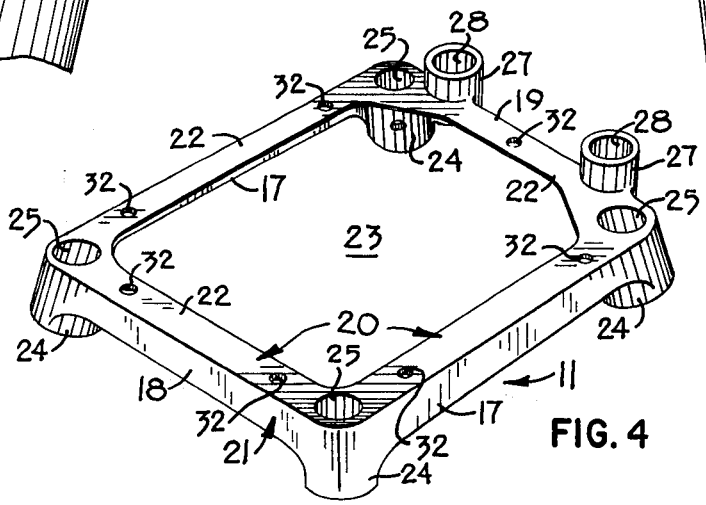
FIG. 4 is a view in perspective of the base frame of this invention.

The base frame 11 is cast or otherwise molded as a single piece, being preferably of metal or suitable high strength plastic material, the same being generally rectangular in form and including a pair of laterally spaced side portions 17, a front portion 18, and a rear portion 19. As shown, particularly in FIG. 4, the base frame 11 comprises a top flange 20 and a peripheral depending skirt 21, the top flange 20 having a generally flat top surface 22. As shown in FIGS. 3 and 4, the top flange 20 is relatively narrow, so that the base frame 11 defines a large central opening 23. Thus, the weight of the base frame may be kept at a reasonable minimum without sacrificing strength and rigidity.

The corner portions of the base frame 11 are formed to provide downwardly projecting bosses 24 each of which is formed to define a recess 25 which opens downwardly to receive a respective one of the legs 12 and 13. In the embodiment of the invention illustrated, the recesses 25 extend completely through the entire length of the bosses 24. With reference particularly to FIG. 3, it will be seen that the recesses 25 are formed with a slight upward taper, so that the upper ends of their respective legs 12 and 13 might be tightly wedged therein and be rigidly held. Preferably, the bosses 24 are provided with suitable openings for reception of wood screws or the like 26 which are screw threaded into the upper end portions of the legs 12 and 13 to prevent accidental removal of the legs 12 and 13 from the base frame 11.

At its rear portion 19, the base frame 11 is formed to provide a pair of laterally spaced bosses 27 that are disposed generally intermediate the rear bosses 24 and which define upwardly opening recesses 28 for reception of the lower ends of the backrest supporting rods 16. Preferably, the recesses 28 are formed with a downward taper so that the lower end portions of the rods 16 are tightly wedged therein. The bosses 27 are provided with lateral openings therethrough for reception of wood screws or like fastening 29, one of which is shown in FIG. 3, these being screw threaded into the lower end portions of the rods 16.

As shown, the seat element 14 is adapted to rest on the top surface 22 of the top flange 20 and, in the embodiment illustrated, is provided with openings 30 for reception of the bosses 27. The seat element 14 is rigidly held against the top surface of the top flange 20 by wood screws or like fastenings 31 that project upwardly through suitable openings 32 in the top flange 20, and which are screw threaded into the seat element 14, as shown in FIG. 3.

The above-described base frame 11 can be used with seat elements, legs and backrest structures of any desired design, it being only necessary that the legs and backrest structures have portions that can be received in the recesses 25 and 28 respectively. The snug and rigid mounting of the upper ends of the legs 12 and 13 in their respective recesses 25 eliminates the necessity for other connections between the legs 12 and 13, such as rungs, not shown, unless such are used for ornamentation. The particular design of the base frame 11 makes it possible for the chair to be crated and shipped in disassembled form wherein it occupies a minimum of space, assembly of the chair for use being achieved quickly and easily without the need for special tools or adhesives. In most cases, all that is necessary for complete assembly of a chair is a screwdriver and a drill for drilling screwholes into the legs 12 and 13, seat element 14, and backrest supporting rods 16.

While a commercial form of the base frame of this invention, and a single design of chair utilizing the base frame has been shown, it will be appreciated that the same is capable of modification; and that modification may be made without departure from the spirit and scope of the invention, as defined in the claims.

What is claimed is:

1. A chair comprising a generally rectangular rigid one-piece frame member including a horizontal flange having a flat top defining an enlarged central opening, and a peripheral skirt depending from said flange to provide front and rear portions and laterally spaced opposite side portions, said frame member further including a plurality of downwardly extending bosses at the opposite ends of said front, rear and side portions and defining downwardly opening upwardly tapering recesses, and a pair of other bosses extending upwardly from the top surface of said rear frame portion each inwardly spaced from a different one of said downwardly extending bosses at the opposite ends of said rear portion, said upwardly extending bosses having upwardly opening downwardly tapering recesses therein; legs having upper ends received in said downwardly opening recesses; backrest supporting members having lower ends received in said upwardly opening recesses; and a horizontal seat element mounted on said flat top and having a pair of openings therethrough for reception of said upwardly extending bosses; said flange and bosses having transverse openings for reception of anchoring screws for said legs, backrest supporting members and seat element.

2. The chair defined in claim 1 in which said upwardly extending bosses have lower end portions extending downwardly of said flange, said transverse openings in said upwardly extending bosses being disposed in said lower end portion below said flange.

* * * * *